US010693209B2

(12) United States Patent
Artemenko et al.

(10) Patent No.: US 10,693,209 B2
(45) Date of Patent: Jun. 23, 2020

(54) WAVEGUIDE-TO-MICROSTRIP TRANSITION WITH THROUGH HOLES FORMED THROUGH A WAVEGUIDE CHANNEL AREA IN A DIELECTRIC BOARD

(71) Applicant: Limited Liability Company "Radio Gigabit", Nizhny Novgorod (RU)

(72) Inventors: Aleksey Andreevich Artemenko, Nizhny Novgorod (RU); Roman Olegovich Maslennikov, Nizhny Novgorod (RU); Andrey Viktorovich Mozharovskiy, Nizhny Novgorod (RU); Oleg Valer'evich Soykin, Nizhny Novgorod (RU); Vladimir Nikolaevich Ssorin, Nizhny Novgorod (RU)

(73) Assignee: LIMITED LIABILITY COMPANY "RADIO GIGABIT", Nizhny Novgorod (RU)

( * ) Notice: Subject to any disclaimer, the term of this patent is extended or adjusted under 35 U.S.C. 154(b) by 5 days.

(21) Appl. No.: 15/765,432

(22) PCT Filed: Oct. 3, 2016

(86) PCT No.: PCT/RU2016/000659
§ 371 (c)(1),
(2) Date: Jul. 25, 2018

(87) PCT Pub. No.: WO2017/058060
PCT Pub. Date: Apr. 6, 2017

(65) Prior Publication Data

US 2018/0358677 A1 Dec. 13, 2018

(30) Foreign Application Priority Data

Oct. 2, 2015 (RU) ..... 2015141953

(51) Int. Cl.
*H01P 5/107* (2006.01)
*H01P 1/04* (2006.01)
(Continued)

(52) U.S. Cl.
CPC ..... *H01P 5/107* (2013.01); *H01P 1/042* (2013.01); *H01Q 1/50* (2013.01); *H01Q 13/106* (2013.01)

(58) Field of Classification Search
CPC ..... H01P 5/107
(Continued)

(56) References Cited

U.S. PATENT DOCUMENTS 4,453,142 A 6/1984 Murphy
5,528,074 A * 6/1996 Goto et al. ..... H01L 23/66 257/664
(Continued)

FOREIGN PATENT DOCUMENTS

DE 102006019054 A1 10/2007
JP 2007228036 A 9/2007
(Continued)

OTHER PUBLICATIONS

A Novel Waveguide-to-Microstrip Transition for Millimeter-Wave Module Applications written by Villegas, F.J., Stones, D.I., Hung, H.A. published in IEEE Transactions on Microwave Theory and Techniques, vol. 47, Issue 1, Jan. 1999.
(Continued)

*Primary Examiner* — Benny T Lee
(74) *Attorney, Agent, or Firm* — Leason Ellis LLP

(57) ABSTRACT

The invention relates to microwave technology and can be used in measuring technology and wireless communication. The technical result is a waveguide-to-microstrip transition which provides reduced signal transmission losses and increased working bandwidth together with a low wave
(Continued)

reflection coefficient. A contacting metal layer is arranged on an upper surface of a dielectric circuit board around a micro-strip probe, without electrical contact with the micro-strip probe and a micro-strip transmission line and forming an internal area on the dielectric circuit boar being a wave-guide channel area. A closed waveguide section having a slot in the area of the microstrip transmission line is arranged on the contacting metal layer. At least one metallized transition through-hole is formed along a perimeter around the area of the waveguide channel in the metal layers and in the dielectric circuit board, and at least one non-metallized through-hole is formed inside the waveguide channel area.

15 Claims, 8 Drawing Sheets

(51) Int. Cl.
*H01Q 1/50* (2006.01)
*H01Q 13/10* (2006.01)

(58) Field of Classification Search
USPC ..... 333/26
See application file for complete search history.

(56) References Cited

U.S. PATENT DOCUMENTS 5,606,737 A * 2/1997 Suzuki et al. ..... G01S 7/032 332/136
6,242,984 B1 * 6/2001 Stones et al. ..... H01P 5/107 330/295
6,967,542 B2 11/2005 Weinstein
9,270,005 B2 * 2/2016 Leiba et al. ..... H01P 3/003
2004/0041651 A1 * 3/2004 Shono ..... H01P 5/107 333/26
2011/0057741 A1 * 3/2011 Dayan et al. ..... H01P 5/107 333/26
2011/0068990 A1 3/2011 Grzyb et al.
2014/0176253 A1 * 6/2014 Ninnan et al. ..... H01P 5/107 333/26
2015/0270616 A1 * 9/2015 Jafarlou et al. ..... H01Q 13/02 343/786

FOREIGN PATENT DOCUMENTS

RU 93588 U1 4/2010
RU 2486640 C1 6/2013
SU 1739411 A1 6/1992

OTHER PUBLICATIONS

"Design of Wideband Waveguide to Microstrip Transition for 60 GHz Frequency Band" written by Artemenko A., Maltsev A., Maslennikov R., Sevastyanov A., Ssorin V., published in proc. of 41st European Microwave Conference, Oct. 10-13, 2011.
"Wideband Tapered Antipodal Fin-Line Waveguide-to-Microstrip Transition for E-band Applications" written by Mozharovskiy A., Artemenko A., Ssorin V., Maslennikov R., Sevastyanov A., published in proc. of 43rd European Microwave Conference, Oct. 6-10, 2013.

* cited by examiner l)

m)

WAVEGUIDE-TO-MICROSTRIP TRANSITION WITH THROUGH HOLES FORMED THROUGH A WAVEGUIDE CHANNEL AREA IN A DIELECTRIC BOARD

CROSS-REFERENCE TO RELATED PATENT APPLICATIONS

This application is a U.S. National Phase Application under 35 U.S.C. 371 of International Patent Application No. PCT/RU2016/000659 filed on Oct. 3, 2016 and claims the benefit of priority to Russian Patent Application No. RU 2015141953 filed on Oct. 2, 2015, all of which are incorporated by reference in their entireties. The International Application was published on Apr. 6, 2017 as International Publication No. WO 2017/058060 A1.

FIELD OF THE INVENTION

The present invention generally relates to the field of microwave frequency devices and more specifically to waveguide-to-microstrip transitions which provide effective transfer of electromagnetic energy between a metal waveguide and a microstrip line realized on a dielectric board. The invention can be used in measurement equipment, antenna systems and in various wireless communication systems and radars.

BACKGROUND OF THE INVENTION

One of the trends in modern wireless communication systems is frequency band extension with simultaneous carrier frequency shift to the millimeter-wave range. In the millimeter-wave region (30-300 GHz) of the electromagnetic spectrum, such applications as indoor local radio networks, radio relay links, automotive radars, microwave imaging devices etc. are already successfully used. For example, communication systems operating in the millimeter-wave range provide significant improvement in data transmission throughput of up to several and even tens of Gb/sec.

Millimeter-wave communication systems and radars have recently found widespread use due to developments in semiconductor technology and the possibility of Transmitter/Receiver (Tx/Rx) implementation on semiconductor integrated circuits (IC) instead of traditional waveguide components of discrete functional parts. Such ICs are usually mounted on dielectric boards, thus forming fully integrated devices. The interconnection between ICs on a dielectric board in most cases is realized by microstrip transmission lines. Meanwhile, some elements of radio devices (for instance, antennas) should principally comprise waveguide interfaces to provide required characteristics (for example, high gain, low loss or high radiated power in case of antennas).

Thus, in order to provide efficient function, millimeter-wave communication systems require an effective waveguide-to-microstrip transition for electromagnetic signal transfer in any direction between a waveguide and a planar transmission line realized on a dielectric board. Moreover, in addition to radio communication systems and radars, such transitions are used in microwave measurement equipment where waveguides are utilized as low-loss transmission lines.

General requirements for waveguide-to-microstrip transitions used in modern millimeter-wave communication systems include wide operational bandwidth, low level of insertion loss, low fabrication cost in mass production and simple construction for easy integration into the communication device.

Some configurations of known waveguide-to-microstrip transitions which can be used in millimeter-wave devices are considered below.

A waveguide-to-microstrip transition based on a stepped waveguide structure (so-called "ridged waveguide") is known from the paper "A Novel Waveguide-to-Microstrip Transition for Millimeter-Wave Module Applications" written by Villegas, F. J., Stones, D. I., Hung, H. A. published in IEEE Transactions on Microwave Theory and Techniques, Vol.: 47, Issue 1, January 1999. A dielectric board with a microstrip line is positioned along the waveguide longitudinal axis. The line is electrically connected to the highest step of the ridged waveguide. Drawbacks of such transition include high complexity and therefore high manufacturing cost. Furthermore, there are some issues related to the positioning of the board in the waveguide channel leading to worse performance and poor repeatability. These disadvantages are further amplified with the increase of operational frequencies to the millimeter-wave range.

Another waveguide-to-microstrip transition ("Design of Wideband Waveguide to Microstrip Transition for 60 GHz Frequency Band" written by Artemenko A., Maltsev A., Maslennikov R., Sevastyanov A., Ssorin V., published in proc. of 41st European Microwave Conference, 10-13 Oct. 2011) is based on a planar radiating element placed inside an aperture of a waveguide channel. The electromagnetic coupling between the radiating element and the microstrip line is provided by a slot cut in the metal ground layer of the microstrip line. The transition is relatively narrowband due to the resonance nature of the slot and the radiating element. Moreover, such a transition requires several dielectric layers on the board, thus increasing structure complexity and sensitivity of the transition to manufacturing error. Finally, the presence of the dielectric board inside the waveguide channel leads to additional signal loss related to dielectric loss in the substrate.

Yet another waveguide-to-microstrip transition is known from the paper "Wideband Tapered Antipodal Fin-Line Waveguide-to-Microstrip Transition for E-band Applications" written by Mozharovskiy A., Artemenko A., Ssorin V., Maslennikov R., Sevastyanov A., published in proc. of 43rd European Microwave Conference, 6-10 Oct. 2013. In this transition, a dielectric board with a printed microstrip line is clamped between two metal parts forming a waveguide channel along the transmission line. Due to such an arrangement, the transition experiences a high level of parasitic radiation from the board end face that leads to significant insertion loss. Moreover, the need for manufacturing two metal parts forming a waveguide channel leads to strict requirements for flatness and surface roughness which lead to an increase in manufacturing costs.

The closest prior-art of the present invention is a waveguide-to-microstrip transition described in the U.S. Pat. No. 6,967,542 filed on Dec. 30, 2004. The prior-art transition is composed of a dielectric board with a microstrip line and a microstrip probe which is placed between an input waveguide and a short-circuited waveguide of similar cross-section profile. The shorted waveguide is located at the same board side with the line and the probe. At the same time, the input waveguide which is often formed by the interface of a specific bulky radio communications device is arranged on the microstrip ground side of the board. Such mutual arrangement of the transition elements provides enough space on the board for IC integration, with such ICs connectable to the microstrip line. The input waveguide piece can comprise a flange arranged on the dielectric board and providing electrical contact between the waveguide and the microstrip ground directly or via through-holes made in the board.

The main drawback of the transition described in the U.S. Pat. No. 6,967,542 filed on Dec. 30, 2004 is the emergence of an equivalent LC circuit (resonant circuit) formed by the waveguides and a portion of the dielectric board that is located inside the waveguide channel. The resonant nature of the LC circuit limits the operational bandwidth of the device and therefore necessitates the use of additional features on the board providing an extension of the transition operational bandwidth. For example, in the prior-art transition, a microstrip quarter-wave impedance transformer, different matching microstrip stubs etc. are utilized for this purpose. These elements significantly complicate the transition design and decrease manufacturing tolerances. Another disadvantage is an increase in insertion loss between the line and the waveguide which is caused by the presence of the dielectric board substrate in the waveguide channel area.

Thus, there is a need for a probe-type waveguide-to-microstrip line transition providing a wide operational bandwidth and low insertion loss with a structure that does not contain any parasitic capacitance of the impedance between the probe and the waveguide channel. In such a transition, there is no need for special parasitic capacitance compensation techniques, thus significantly simplifying device structure, easing the precision requirements in manufacturing and mutual positioning of the board with the microstrip line with respect to the waveguide channel.

SUMMARY OF THE INVENTION

The object of the present invention is to provide a probe-type waveguide-to-microstrip transition with wide bandwidth and low insertion loss, the transition comprising a structure which does not produce the parasitic capacitance of the impedance between the probe and the waveguide channel.

The invention provides the following advantages: a decrease in insertion loss and an extended operational bandwidth with a low wave reflection coefficient of the waveguide-to-microstrip transition.

The object is achieved by a waveguide-to-microstrip transition comprising an input waveguide piece having a through-hole defining an open waveguide channel, a short-circuited waveguide piece having a blind cavity defining a closed waveguide channel, and a dielectric board placed between the waveguide pieces; wherein the top surface of the dielectric board comprises a microstrip transmission line, a microstrip probe formed as an extension of the microstrip transmission line, and a contact metal layer, wherein the contact metal layer surrounds the microstrip probe with no electrical connection to the microstrip probe and the microstrip transmission line and forms an internal area on the dielectric board, the internal area being a waveguide channel area; wherein the short-circuited waveguide piece is located on the contact metal layer and has a recess in the area of the microstrip transmission line, while the bottom surface of the dielectric board comprises a ground metal plane surrounding the waveguide channel area, the input waveguide piece being mounted on the ground metal plane, wherein at least one metallized transition through-hole is provided along the circumference around the waveguide channel area in the metal layers and in the dielectric board, and wherein at least one non-metallized through-hole is provided within the waveguide channel area on the dielectric board.

In one embodiment, the dielectric board and the metal layers have metallized mounting through-holes to provide connection of the board and the waveguide pieces.

In another embodiment, the metallized transition through-hole can be configured to electrically connect the contact metal layer and the ground metal plane with the input and short-circuited waveguide pieces.

In one particular embodiment, the dielectric board can comprise at least two dielectric layers while the bottom surface of each of dielectric layers comprises a ground metal plane, so one of the ground metal planes is in-between and another is a ground lead of the microstrip transmission line.

In one another embodiment, the microstrip probe has a circular, sectoral, rectangular or trapezoidal longitudinal section.

In one more embodiment, the waveguide channel has a rectangular, circular or elliptical cross-section.

In some particular embodiments, the closed waveguide channel of the short-circuited waveguide piece has a rectangular, circular or trapezoidal longitudinal cross-section.

In one embodiment, the non-metallized through-hole is symmetrically located at each side of the probe within the waveguide channel area on the dielectric board.

In another embodiment, the non-metallized through-hole is arranged within the waveguide channel area on the dielectric board, the hole having a perimeter substantially matching the overall section of the waveguide channel area not occupied by the probe.

In one particular embodiment, the input waveguide piece is electrically connectable with a horn antenna.

In one more embodiment, the input waveguide piece is electrically connectable with a diplexer.

In one embodiment, the dielectric board is fabricated using technology selected from a group consisting of: printed circuit board technology; low temperature co-fired ceramic technology; laser transfer printing technology; thin-film technology; liquid crystal polymer technology.

In another embodiment, the waveguide pieces are made of a dielectric material covered with metal.

In one particular embodiment, the waveguide pieces are made of metal.

In one another embodiment, the open and closed waveguide channels are partially or fully filled with a dielectric material.

In one more embodiment, an integrated circuit is mounted on the dielectric board and configured to electrically connect to the microstrip transmission line by means of surface-mount technology.

In some particular embodiments, the dielectric board has a special cavity provided for an integrated circuit to be mounted therein.

BRIEF DESCRIPTION OF THE DRAWINGS

Further features and advantages of the present invention will become apparent from the following description of the preferred embodiments with reference to accompanying drawings, where like features in the drawing figures are denoted by the same reference numbers, which may not be described in all drawing figures in which they appear.

a) a general view of the transition;

b) a longitudinal cross-section made along the A-A' line in a);

c) a top view of the dielectric board according to an embodiment wherein the microstrip probe has a rectangular cross-section;

d) a bottom view of the dielectric board;

e) a top view of the dielectric board according to an embodiment wherein the microstrip probe has a circular cross-section;

f) a top view of the dielectric board according to an embodiment wherein the microstrip probe has a sectoral cross-section;

g) a top view of the dielectric board according to an embodiment wherein the microstrip probe has a trapezoidal cross-section;

h) a top view of the input waveguide piece according to an embodiment wherein the open waveguide channel has a circular cross-section;

i) a top view of the input waveguide piece according to an embodiment wherein the open waveguide channel has an elliptical cross-section;

j) a top view along horizontal section line B-B' in a) of the short-circuited waveguide piece according to an embodiment wherein the closed waveguide channel has a circular cross-section;

k) a top view along horizontal section line B-B' in a) of the short-circuited waveguide piece according to an embodiment wherein the closed waveguide channel has a trapezoidal cross-section;

l) a side view of the input waveguide piece connected to a horn antenna;

m) a side view of the input waveguide piece connected to a diplexer;

n) a longitudinal cross-section made along the A-A' line in a) according to an embodiment wherein the input waveguide piece and the short-circuited waveguide piece are made of a dielectric material covered with metal;

o) a top view of the input waveguide piece according to an embodiment wherein the open waveguide channel is partially filled with a dielectric material;

p) a top view of the input waveguide piece according to an embodiment wherein the open waveguide channel is fully filled with a dielectric material;

q) a top view along horizontal section line B-B' in a) of the short-circuited waveguide piece according to an embodiment wherein the closed waveguide channel is partially filled with a dielectric material;

r) a top view along horizontal section line B-B' in a) of the short-circuited waveguide piece according to an embodiment wherein the closed waveguide channel is fully filled with a dielectric material;

s) a top view of the dielectric board having an integrated circuit mounted on it within a special cavity, the integrated circuit electrically connected to the microstrip transmission line by means of surface-mount technology.

Figure 2:
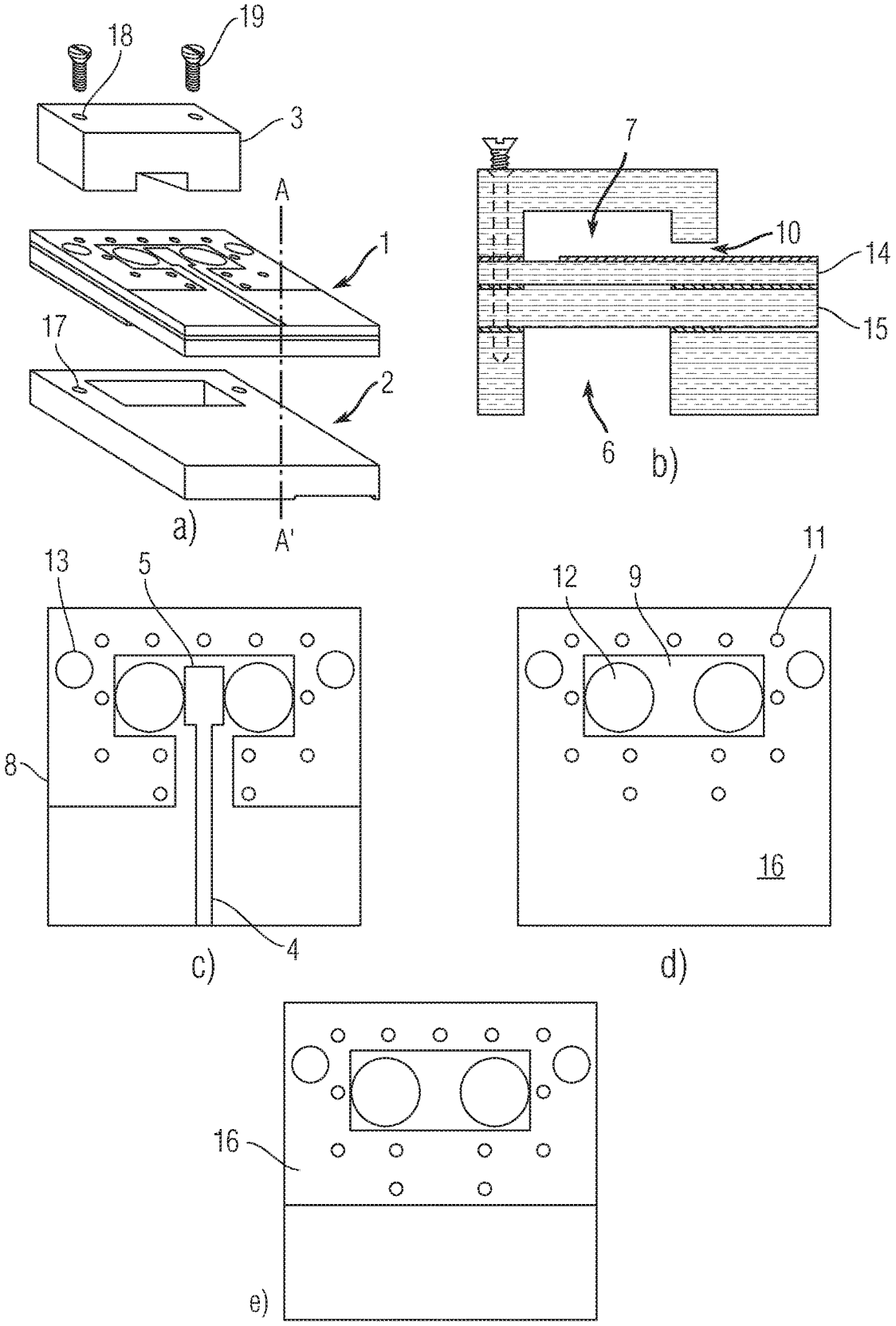

FIG. 2 shows an embodiment of a waveguide-to-microstrip transition with a dielectric board having two dielectric layers according to the present invention wherein the views depicted in the drawing figure are as follows:

a) a general view of the transition;

b) a longitudinal section made along the A-A' line in a);

c) a top view of the dielectric board;

d) a top view of the ground metal layer placed between two dielectric layers of the dielectric board;

e) a bottom view of the dielectric board.

LIST OF REFERENCE NUMERALS

1—dielectric board;
2—input waveguide piece;
3—short-circuited waveguide piece;
4—microstrip transmission line;
5—microstrip probe;
6—open waveguide channel;
7—closed waveguide channel;
8—contact metal layer;
9—waveguide channel area;
10—recess;
11—metallized transition through-hole;
12—non-metallized through-hole;
13—metallized mounting through-holes;
14—first dielectric layer;
15—second dielectric layer;
16—ground metal plane;
17—input waveguide piece mounting holes;
18—short-circuited waveguide piece mounting holes;
19—mounting elements;
20—horn antenna;
21—diplexer;
22—metal covering;
23—dielectric;
24—integrated circuit;
25—electrical connection;
26—special cavity.

DETAILED DESCRIPTION OF THE INVENTION

Figure 1:
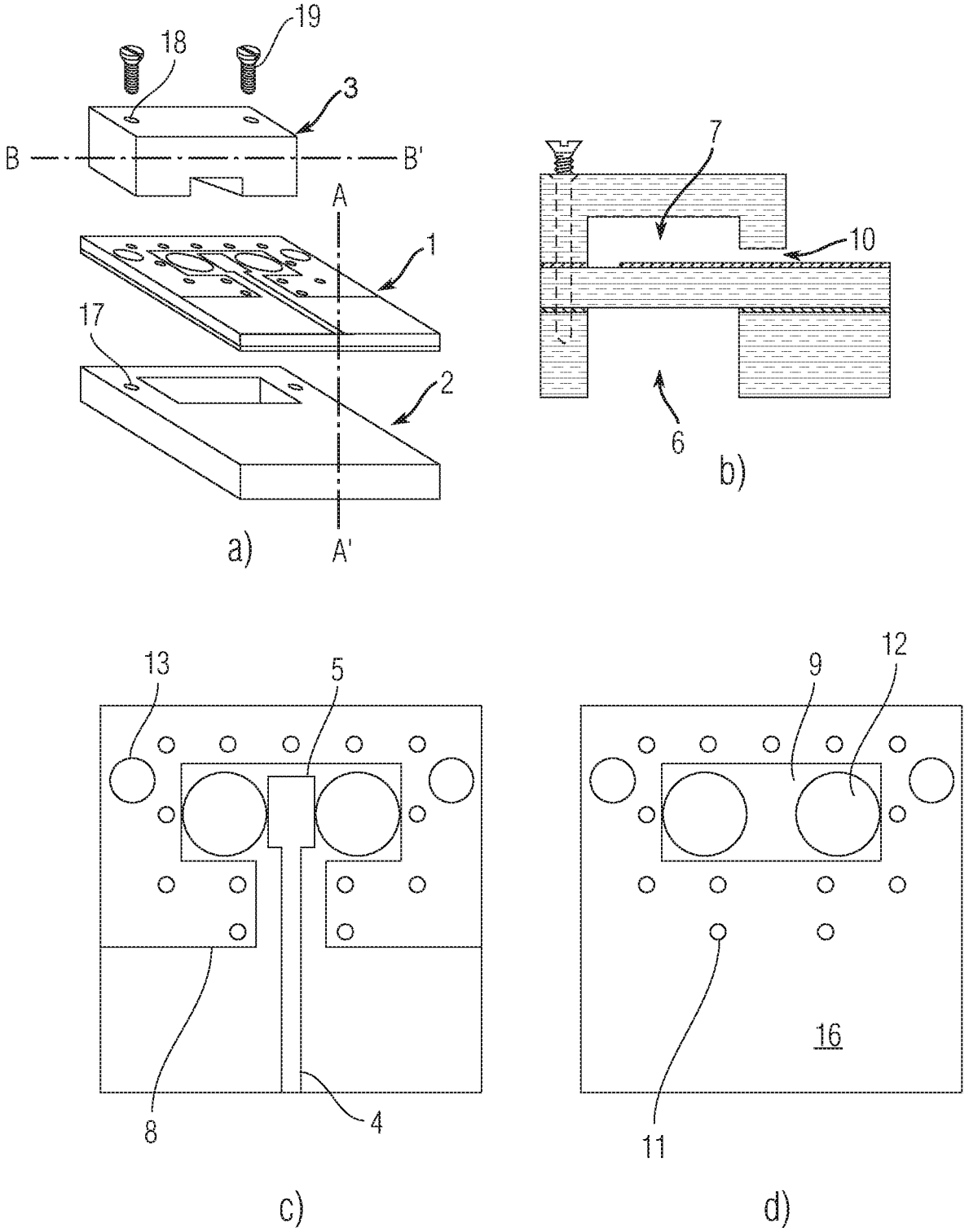
FIG. 1 illustrates a waveguide-to-microstrip transition realized on the board that consists of a single dielectric layer according to the present invention wherein the views depicted in the drawing figure are as follows.
Figure 1:
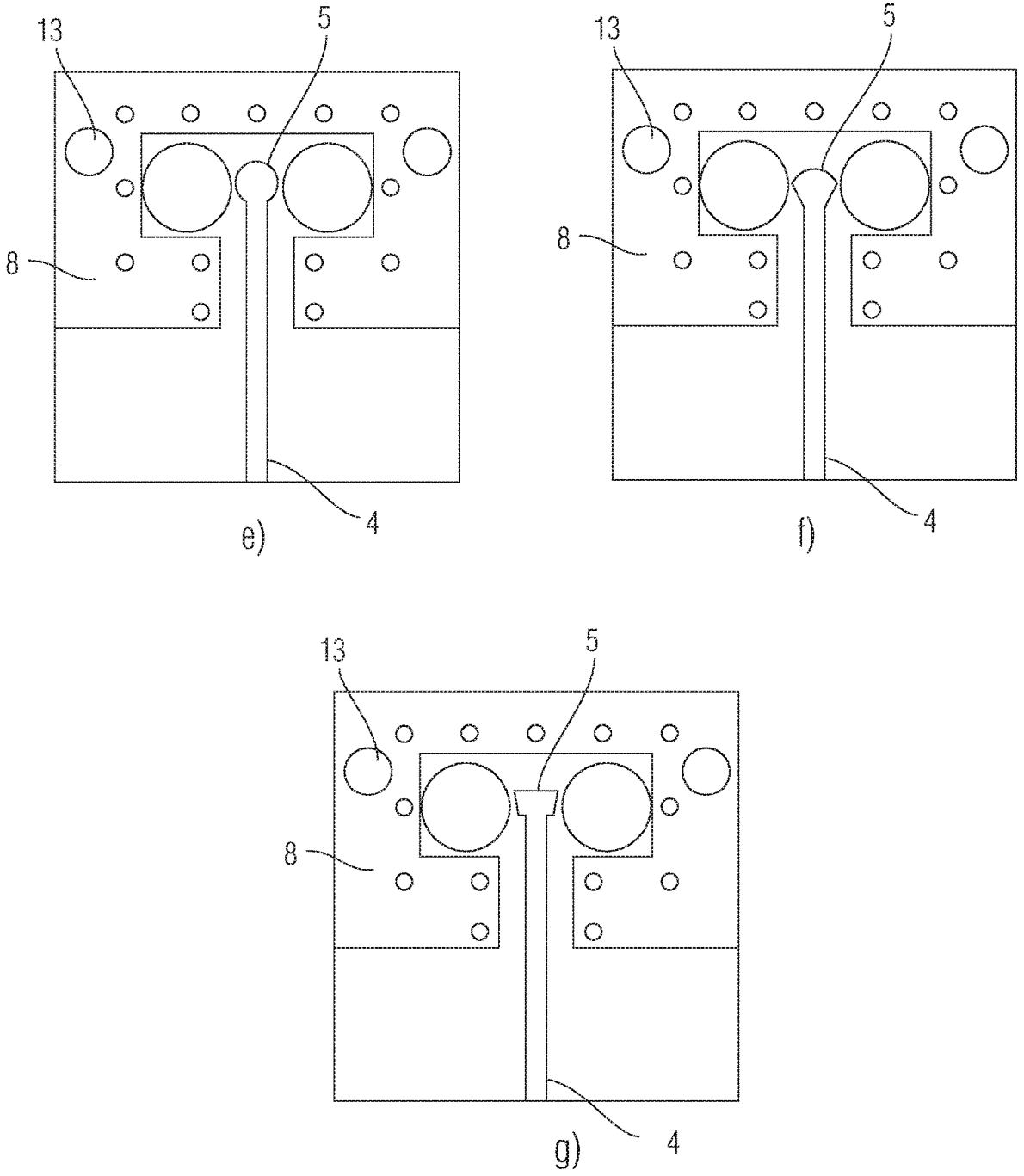
Figure 1:
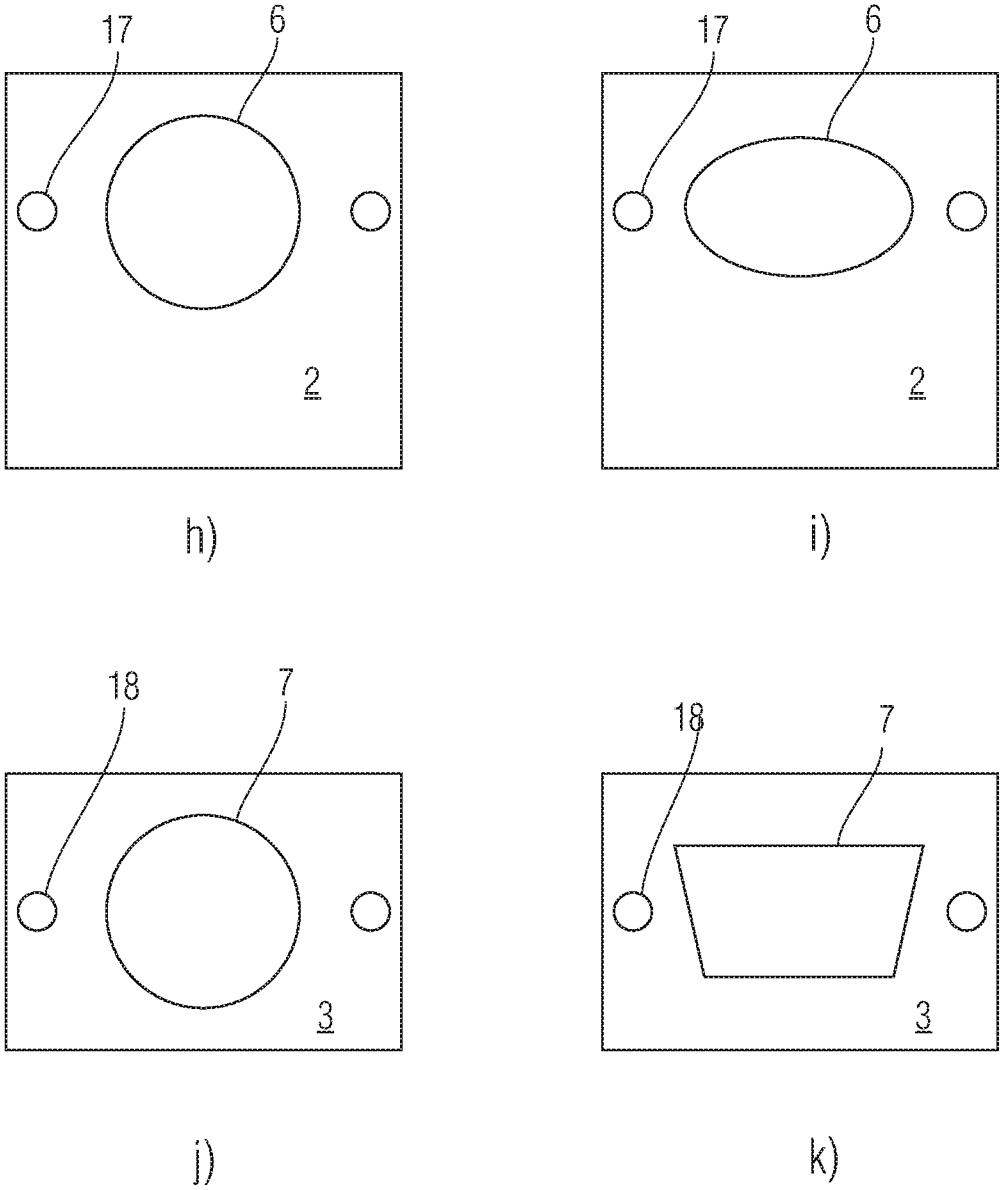
Figure 1:
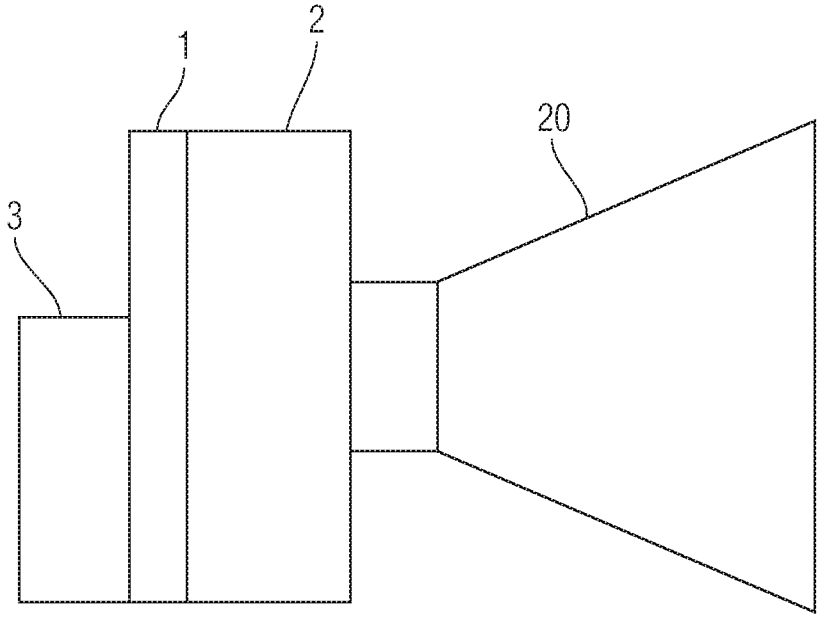
Figure 1:
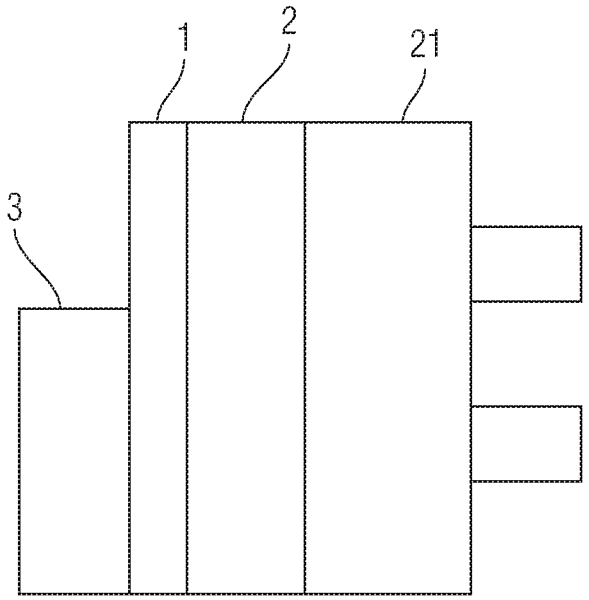
Figure 1:
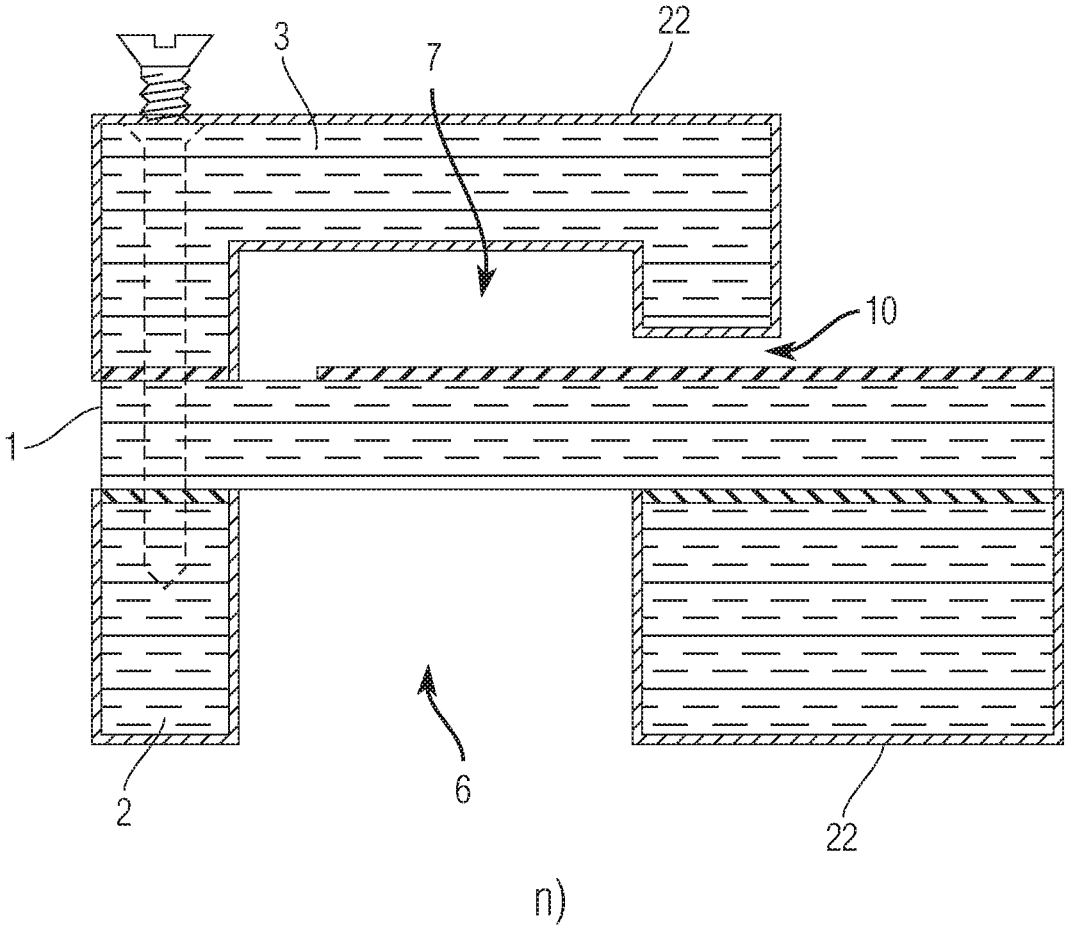
Figure 1:
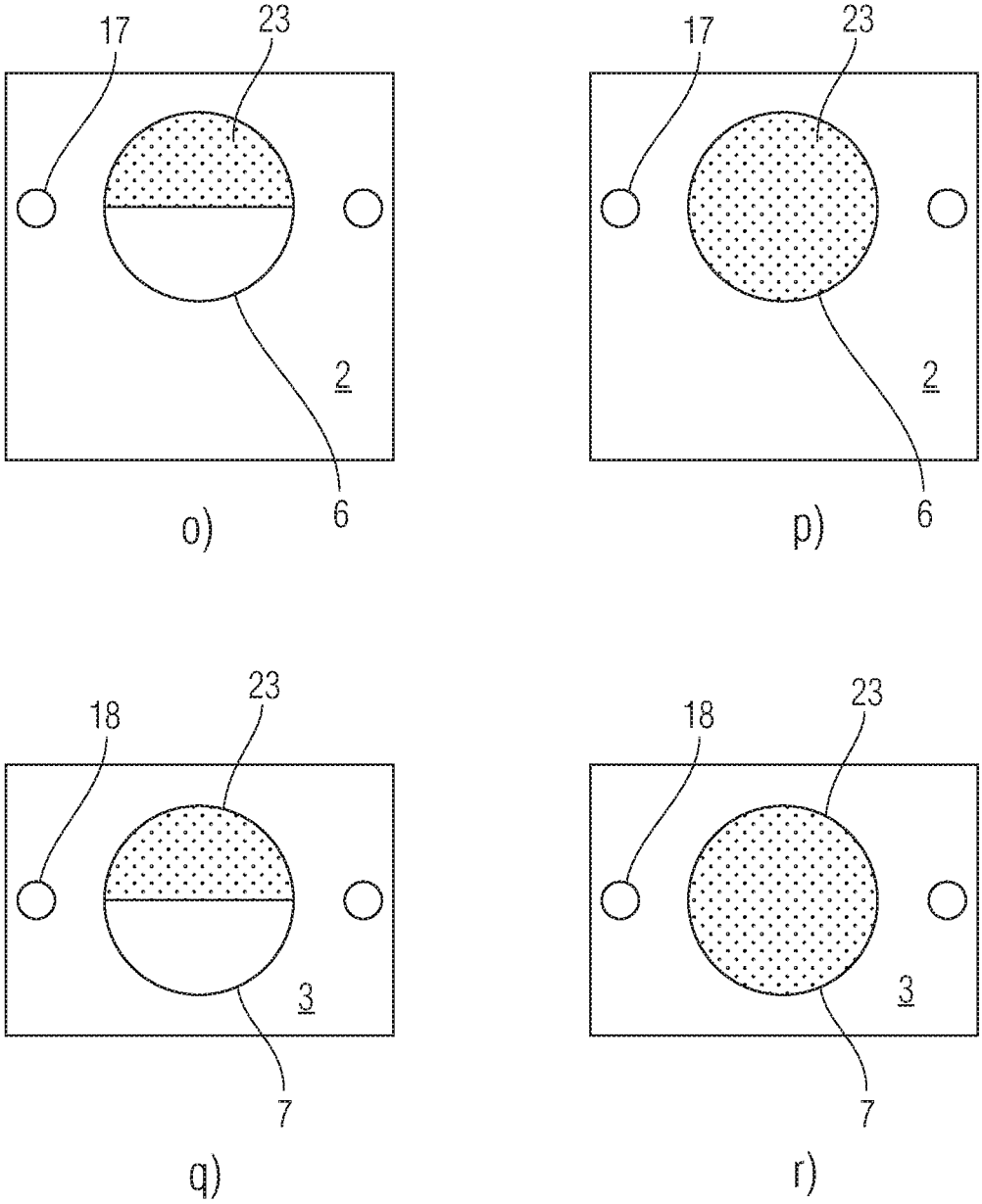
Figure 1:
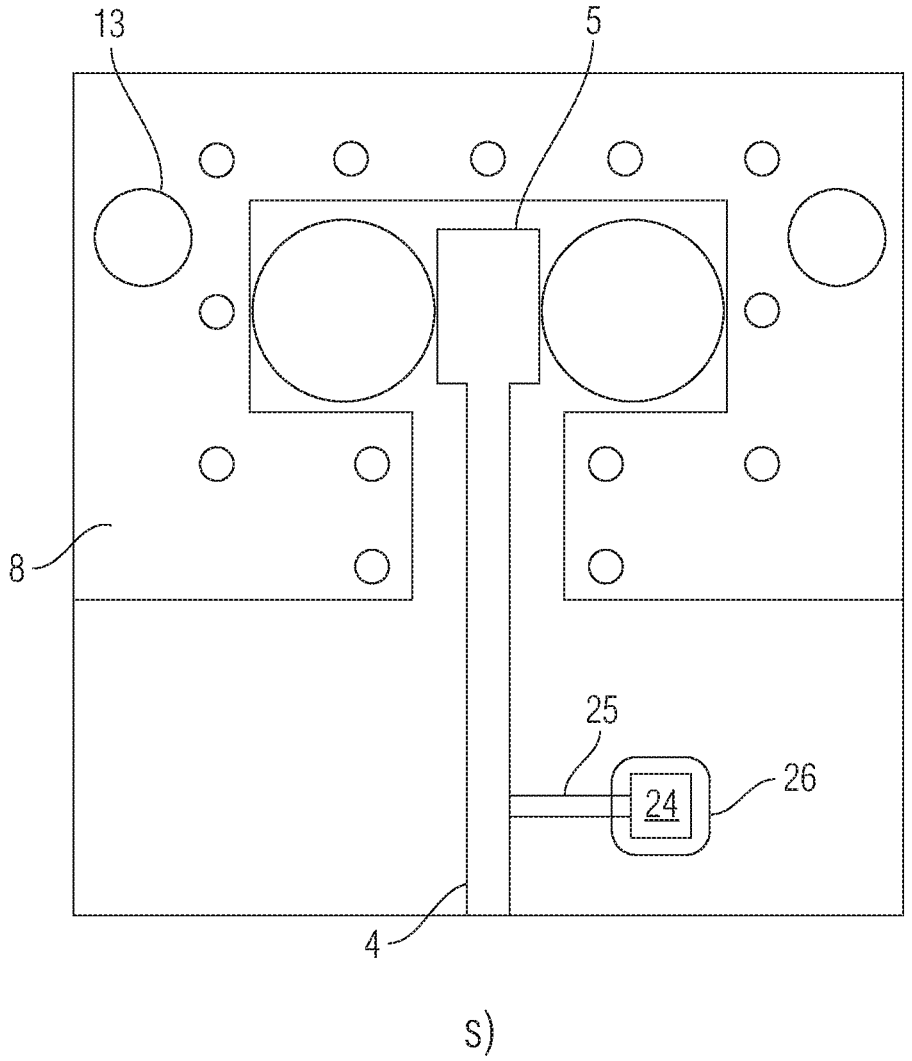

A waveguide-to-microstrip transition comprises an input waveguide piece 2 having a through-hole defining an open waveguide channel 6 (appears in drawing figures a) in FIGS. 1 and 2), a short-circuited waveguide piece 3 (each appears in drawing figures a) of FIGS. 1 and 2) having a blind cavity defining a closed waveguide channel 7 (appears in drawing figures b) of FIGS. 1 and 2), and a dielectric board 1 (appears in drawing figures a) in FIGS. 1 and 2) placed between the waveguide pieces 2, 3 (each appears in drawing figures a) of FIGS. 1 and 2). The top surface of the dielectric board 1 comprises a microstrip transmission line 4, a microstrip probe 5 formed as an extension of the microstrip transmission line 4, and a contact metal layer 8 surrounding the microstrip probe 5 with no electrical connection to the microstrip probe 5 and the microstrip transmission line 4, wherein the contact metal layer 8 forms an internal area on the dielectric board 1, the internal area being a waveguide channel area 9 (appears in drawing figures d) of FIGS. 1 and 2).

The waveguide short-circuited piece 3 is located on the contact metal layer 8 and has a recess 10 (appears in drawing figures b) in FIGS. 1 and 2) in the area of the microstrip transmission line 4, while the bottom surface of the dielectric board 1 comprises a ground metal plane 16 surrounding the waveguide channel area 9, the input waveguide piece 2 being mounted on the ground metal plane 16.

At least one metallized transition through-hole 11 (appears in drawing figures d) of FIGS. 1 and 2) is provided along the circumference around the waveguide channel area 9 (appears in drawing figures d) of FIGS. 1 and 2) in the metal layers and in the dielectric board 1, and at least one non-metallized through-hole 12 (each appears in drawing figures d) of FIGS. 1 and 2) is provided within the waveguide channel area 9 (appears in drawing figures d) of FIGS. 1 and 2) on the dielectric board 1 (appears in drawing figures a) of FIGS. 1 and 2).

The dielectric board 1, the contact metal layer 8 and the ground metal plane 16 include metallized mounting through-holes 13 (appears in drawing figures c) in FIGS. 1 and 2) which can be used to connect the dielectric board 1 with the input waveguide piece 2 and the short-circuited waveguide piece 3 (each appears in drawing figures a) of FIGS. 1 and 2).

At least one metallized transition through-hole 11 can be configured to electrically connect the contact metal layer 8 and the ground metal plane 16 with the input waveguide piece 2 and the short-circuited waveguide piece 3 (each appears in drawing figures a) of FIGS. 1 and 2).

The dielectric board 1 can comprise at least two dielectric layers, a first dielectric layer 14 and a second dielectric layer 15 (appears in drawing figures a) of FIGS. 1 and 2), with a ground metal plane 16 in-between (appears in drawing figures d) and e) of FIG. 2), the ground metal plane 16 is a ground lead of the microstrip transmission line 4 (each appears in drawing figures e), f) and g) of FIG. 1, respectively).

The microstrip probe 5 (appears in drawing figures b), h) and i) of FIG. 1 respectively) has a circular, sectoral, rectangular or trapezoidal longitudinal section.

The waveguide channel 6 (appears in drawing figures a) of FIGS. 1 and 2) has a rectangular, circular or elliptical cross-section.

The closed waveguide channel 7 (appears in drawing figures j) and k) of FIG. 1 respectively) has a rectangular, circular or trapezoidal longitudinal cross-section.

At least one non-metallized through-hole 12 is symmetrically located at each side of the microstrip probe 5 (each appears in drawing figures a) of FIGS. 1 and 2) within the waveguide channel area 9 (appears in drawing figures d) of FIGS. 1 and 2) of the dielectric board 1 (appears in drawing figures a) of FIGS. 1 and 2).

The non-metallized through-hole 12 (appears in drawing figures a) of FIGS. 1 and 2) is arranged within the waveguide channel area 9 (appears in drawing figures d) of FIGS. 1 and 2) on the dielectric board 1 (appears in drawing figures a) of FIGS. 1 and 2), said hole having a perimeter substantially matching the overall section of the waveguide channel area 9 (appears in drawing figures d) of FIGS. 1 and 2) not occupied by the microstrip probe 5 (appears in drawing figures a) of FIGS. 1 and 2).

The input waveguide piece 2 (appears in drawing figures a) of FIGS. 1 and 2) can be electrically connected with a horn antenna 20, as shown in drawing figure l) of FIG. 1.

The input waveguide piece 2 (appears in drawing figures a) of FIGS. 1 and 2) can be electrically connected with a diplexer 21, as shown in drawing figure m) of FIG. 1.

The dielectric board 1 (appears in drawing figures a) of FIGS. 1 and 2) is fabricated using technology selected from a group consisting of: printed circuit board technology; low temperature co-fired ceramic technology; laser transfer printing technology; thin-film technology; liquid crystal polymer technology.

The input waveguide piece 2 and the short-circuited waveguide piece 3 (each appears in drawing figures a) of FIGS. 1 and 2) can be made of a dielectric material covered with metal 22, as shown in drawing figure n) of FIG. 1.

The input waveguide piece 2 and the short-circuited waveguide piece 3 (each appears in drawing figures a) of FIGS. 1 and 2) can be made of metal.

The open waveguide channel 6 (appears in drawing figures b) of FIGS. 1 and 2) and the closed waveguide channel 7 (appears in drawing figures b) of FIGS. 1 and 2) are partially or fully filled with a dielectric material 23, as shown in drawing figures o), p), q), and r) of FIG. 1.

As shown in drawing figure s) of FIG. 1, an integrated circuit 24 is mounted on the dielectric board 1 and configured to electrically connect at 25 to the microstrip transmission line 4 (each appears in drawing figures a) of FIGS. 1 and 2) by means of surface-mount technology.

The dielectric board 1 (appears in drawing figures a) of FIGS. 1 and 2) has a special cavity 26 provided for an integrated circuit to be mounted therein, also as shown in drawing figure s) of FIG. 1.

The transition operates as follows.

With reference to FIG. 1, for accurate mutual positioning of the transition components, the single-layer dielectric board 1 with the microstrip transmission line 4 and the microstrip probe 5 and the contact metal layer 8 surrounding the microstrip probe 5 and the microstrip transmission line 4 at the top surface of the dielectric board 1 and with the ground metal plane 16 (each appears in drawing figures d) of FIGS. 1 and 2) surrounding the waveguide channel area 9 (appears in drawing figures d) of FIGS. 1 and 2) is placed between the input waveguide piece 2 and the short-circuited waveguide piece 3 with the help of fixing elements 19 and corresponding metallized mounting through-holes 13 provided in the dielectric board 1 in the contact metal layer 8 and the ground metal plane 16 and with the help of the input waveguide piece mounting holes 17 and the waveguide short-circuited piece mounting holes 18 (each appears in drawing figures a) of FIGS. 1 and 2).

In a single-layer dielectric board 1, the contact metal layer 8 and the ground metal plane 16 (each appears in drawing figures d) of FIGS. 1 and 2) at the periphery of the waveguide channel area 9 (appears in drawing figures d) of FIGS. 1 and 2) have metallized transition through-holes 11 for electrical connection of the ground metal plane 16 of the microstrip transmission line 4 with the input waveguide piece 2 and the short-circuited waveguide piece 3 (each appears in drawing figures a) of FIGS. 1 and 2).

To reduce the capacitive part of the impedance reactance between the microstrip probe 5 and the waveguide channel 6 which is brought by the dielectric board 1, two non-metallized through-holes 12 with circular shape are provided in the dielectric board 1 (each appears in drawing figures a) of FIGS. 1 and 2).

The diameter of non-metallized through-holes 12 in the dielectric board 1 is as large as possible with respect to the dielectric board 1 (each appears in drawing figures a) of FIGS. 1 and 2) manufacturing technology but limited by the waveguide channel size. This allows effective removal of the parasitic capacitance of the reactance, with the shape and the size of the microstrip probe 5 (appears in drawing figures c) of FIGS. 1 and 2) selected to achieve impedance matching in the required frequency band. Thus, such implementation allows achieving high level of transition performance. At the same time, it is clear that large non-metallized through-holes 12 (appears in drawing figures d) of FIGS. 1 and 2) can be replaced with a plurality of holes having a smaller diameter.

A microwave signal is applied to the microstrip transmission line 4 where it propagates as quasi-TEM mode of electromagnetic waves. The signal passing through the microstrip transmission line 4 (each appears in drawing figures c) of FIGS. 1 and 2) reaches the waveguide channel area 9 (appears in drawing figures d) of FIGS. 1 and 2) of the dielectric board 1 where the microstrip probe 5 serves as matching element between the input waveguide piece 2 and the short-circuited waveguide piece 3 and the microstrip transmission line 4 (each appears in drawing figures c) of FIGS. 1 and 2). In the waveguide channel area 9 (appears in drawing figures d) of FIGS. 1 and 2), a portion of the signal is radiated into the waveguide channel 6 of the input waveguide piece 2 by the microstrip probe 5 (each appears in drawing figures c) of FIGS. 1 and 2).

The remaining portion of the signal is radiated into the closed waveguide channel 7 (appears in drawing figures b) of FIGS. 1 and 2) of the short-circuited waveguide piece. The distance between the microstrip probe 5 (appears in drawing figures c) of FIGS. 1 and 2) and short-circuiting of the closed waveguide channel 7 (appears in drawing figures b) of FIGS. 1 and 2) of the short-circuited waveguide piece is about a quarter of the electrical wavelength, thus providing coherent in-phase addition of the direct electromagnetic wave radiated into the waveguide channel 6 and the electromagnetic wave reflected back from the channel 7 (appears in drawing figures b) of FIGS. 1 and 2) of the short-circuited waveguide piece. Then the total signal propagates through the waveguide channel 6 (appears in drawing figures b) of FIGS. 1 and 2) of the input waveguide piece 2 (each appears in drawing figures a) of FIGS. 1 and 2) in the form of TE10 waveguide mode.

The dielectric board of the proposed transition can be multilayer which is required when either of IC integration on the board, development of high-density printed circuits or implementation of different multi-layer passive devices (antennas, cross-connections) is necessary. For example, a waveguide-to-microstrip transition according to one of the embodiments of the invention with the board comprising two dielectric layers is shown in FIG. 2.

The transition contains the dielectric board 1 with two dielectric layers 14, 15 placed between the input waveguide piece 2 and the short-circuited waveguide piece 3 which include the open waveguide channel 6 (each appears in drawing figure b) of FIG. 2) and the closed waveguide channel 7 (appears in drawing figures b) of FIG. 1). The ground metal plane 16 surrounding the waveguide channel area 9 is located between the first dielectric layer 14 and the second dielectric layer 15 and in this case it is the microstrip transmission line 4 (each appears in drawing figure b) of FIG. 2) ground lead.

The top side of the first dielectric layer 14 of the dielectric board 1 comprises the microstrip transmission line 4, the microstrip probe 5 and the contact metal layer 8 surrounding the microstrip probe 5 and the microstrip transmission line 4, while the bottom side of the second dielectric layer 15 of the dielectric board 1 includes ground metal plane 16 (each appears in drawing figure e) of FIG. 2) surrounding the waveguide channel area 9 (appears in drawing figures d) of FIGS. 1 and 2). The dielectric board 1 with the first dielectric layer 14, the second dielectric layer 15, the contact metal layer 8 and the ground metal plane 16 have transition metallized through-holes 11 (each appears in drawing figure d) of FIG. 2) along the circumference of the waveguide channel area 9 (appears in drawing figures d) of FIGS. 1 and 2) for electrical connection of the contact metal layer 8 and the ground metal plane 16 with the input waveguide piece 2 and the short-circuited waveguide piece 3 (each appears in drawing figure a) of FIG. 2).

It should be mentioned that the dielectric board 1 of the transition can have more than two dielectric layers, and the ground lead of the microstrip transmission line 4 (each appears in drawing figure c) of FIG. 2) can be realized at the bottom side of the board or in some inner ground planes of the dielectric layers.

Transition characteristics for operation in specific frequency bands can be tuned by picking various probe shapes (circular, sectoral, trapezoidal) and parameters of non-metallized through-holes 12 (appears in drawing figures d) of FIGS. 1 and 2) in the waveguide channel area 9 (appears in drawing figures d) of FIGS. 1 and 2) on the dielectric board 1, for example, symmetrically at each side of the microstrip probe 5 or with the size that coincides with the waveguide channel area 9 non-occupied by the microstrip probe 5 (each appears in drawing figure c) of FIG. 2). In some cases, when bandwidth broadening is required, the board can be provided with additional features: a microstrip quarter-wave impedance transformer, different matching microstrip stubs, etc.

Wideband characteristics matching of the transition is possible if the length of the shorted waveguide channel is equal to about a quarter of the waveguide wavelength. In some specific cases this length can be different, with the length value obtained from electromagnetic simulation results to achieve the best performance of the transition. The values typically range from zero to half the operational wavelength.

The proposed transition may be used, for instance, in transceiver devices of modern millimeter-wave radio-relay communication systems. In particular, the transmitter and the receiver of a radio transceiver module for radio-relay communications can be implemented on multi-layer dielectric boards based on PCB technology. Radio receiver and transmitter ICs can be mounted in cavities in the boards and can be electrically connected with pads and transmission lines on the board by means of wire-bonding technology or using the flip-chip method. Each board can contain a waveguide-to-microstrip transition according to one of the embodiments of the preferred invention.

Such transitions are utilized for electromagnetic transmission between a waveguide and a microstrip line. Waveguide outputs of the transitions can be parts of a waveguide diplexer that allows separating received and transmitted signal to closely spaced frequency bands. In another particular case, the waveguide output may be the input port of a horn antenna or any other antenna with a waveguide input interface.

The disclosed waveguide-to-microstrip transition can operate in various frequency bands within the 50-100 GHz band or higher, for example in the 57-66 GHz and 71-86 GHz bands. These are the most promising bands in terms of implementing various radio communication systems with high data throughput. That makes the disclosed transition promising for utilization in different modern millimeter-wave devices and applications.

Experiments have shown that the proposed transition provides less than 1 dB of signal transmission loss and a 71-86 GHz bandwidth of the reflection coefficient below −20 dB in the whole band, while the closest analogue exhibits signal transmission loss of about 1.5 dB and aforementioned reflection coefficient below −20 dB only for the 8 GHz band that does not cover the entire 71-86 GHz band.

Thus, the proposed invention allows obtaining probe-type waveguide-to-microstrip transition with wide bandwidth, low reflection coefficient, and low signal loss, with a structure that does not introduce the parasitic capacitance of the impedance between the probe and the waveguide channel. The invention was disclosed with the reference to a specific embodiment. Other embodiments of the invention will be evident to those skilled in the art without departing from the scope and spirit of the present invention. Therefore, the invention is intended to be limited only by the appended claims.

The invention claimed is:

1. A waveguide-to-microstrip transition comprising: an input waveguide piece having a through-hole defining an open waveguide channel, a short-circuited waveguide piece having a blind cavity defining a closed waveguide channel, and a dielectric board placed between the input and short-circuited waveguide pieces; wherein a microstrip transmission line, a microstrip probe formed as an extension of the microstrip transmission line, and a contact metal layer are located on a top surface of the dielectric board, wherein the contact metal layer surrounds the microstrip probe with no electrical connection to the microstrip probe and the microstrip transmission line and forms an internal area on the dielectric board, the internal area being a waveguide channel area; wherein the short-circuited waveguide piece is located on the contact metal layer and has a recess in the area of the microstrip transmission line, wherein a ground metal plane surrounding the waveguide channel area is located on a bottom surface of the dielectric board, the input waveguide piece being mounted on the ground metal plane, wherein at least one metallized transition through-hole is provided along the circumference around the waveguide channel area in the contact metal layer, ground metal plane and in the dielectric board, and wherein at least two non-metallized through-holes are provided within the waveguide channel area on the dielectric board.

2. The transition according to claim 1, wherein an integrated circuit is mounted on the dielectric board, the integrated circuit is configured to electrically connect to the microstrip transmission line by means of surface-mount technology.

3. The transition according to claim 2, wherein the dielectric board has a special cavity therein provided for receiving the integrated circuit to be mounted therein, the integrated circuit being configured to have electrical contact with the microstrip transmission line.

4. The transition according to claim 1, wherein the dielectric board includes at least two dielectric layers with the ground metal plane disposed in-between the at least two dielectric layers, the ground metal plane being a ground lead of the microstrip transmission line.

5. The transition according to claim 1, wherein the microstrip probe has a circular, sectoral, rectangular or trapezoidal longitudinal section.

6. The transition according to claim 1, wherein the waveguide channel has a rectangular, circular or elliptical cross-section.

7. The transition according to claim 1, wherein the closed waveguide channel has a rectangular, circular or trapezoidal longitudinal cross-section.

8. The transition according to claim 1, wherein at the least one non-metallized through-hole is symmetrically located at each side of the microstrip probe within the waveguide channel area on the dielectric board.

9. The transition according to claim 1, wherein the dielectric board, the ground metal plane and the contact metal layer have metallized mounting through-holes to provide connection between the board and the input and short-circuited waveguide pieces.

10. The transition according to claim 1, wherein the input waveguide piece is electrically connectable with a horn antenna.

11. The transition according to claim 1, wherein the input waveguide piece is electrically connectable with a diplexer.

12. The transition according to claim 1, wherein the dielectric board is fabricated using technology selected from a group comprising: printed circuit board technology; low temperature co-fired ceramic technology; laser transfer printing technology; thin-film technology; liquid crystal polymer technology.

13. The transition according to claim 1, wherein the input and short-circuited waveguide pieces are each made of a dielectric material covered with metal.

14. The transition according to claim 1, wherein the input and short-circuited waveguide pieces are each made of metal.

15. The transition according to claim 1, wherein the open and closed waveguide channels are partially or fully filled with a dielectric material.

* * * * *